US005425217A

United States Patent [19]

Lobash et al.

[11] Patent Number: 5,425,217

[45] Date of Patent: Jun. 20, 1995

[54] APPARATUS AND METHODS FOR INSERTING FLAT PREMIUM ITEMS

[75] Inventors: Floyd Lobash, Golden Valley; Leo W. Eiden, New Hope, both of Minn.

[73] Assignee: General Mills, Inc., Minneapolis, Minn.

[21] Appl. No.: 155,541

[22] Filed: Nov. 22, 1993

[51] Int. Cl.[6] ..... A21C 15/04

[52] U.S. Cl. ..... 53/435; 53/389.3; 53/520; 53/474; 53/238; 83/165; 271/195

[58] Field of Search ..... 53/474, 238, 237, 240; 83/98, 165, 613, 194; 406/70, 86, 88, 168, 175; 271/195; 55/389.2, 389.3, 435, 520

[56] References Cited

U.S. PATENT DOCUMENTS

| | | | |
|---|---|---|---|
| 3,898,900 | 8/1975 | Schmermund | 53/389.3 |
| 4,010,981 | 3/1977 | Hodge | 406/88 |
| 4,848,974 | 7/1989 | Wayt | 406/88 |
| 4,874,273 | 10/1989 | Tokisue et al. | 406/88 |
| 5,205,991 | 4/1993 | Avery et al. | 406/88 |

*Primary Examiner*—John Sipos
*Assistant Examiner*—Eugene L. Kim
*Attorney, Agent, or Firm*—John A. O'Toole; L. MeRoy Lillehaugen; Alan D. Kamrath

[57] ABSTRACT

Apparatus (10) is disclosed including a series of equally spaced air jets (36) in the center plate (18) of a channel (14). An end cover plate (22) and a cover (48) close the channel (14) to form a tunnel having infeed and outfeed ends. In the most preferred form, the air jets (36) are wedge-shaped depressions formed in the center plate (18) having semicircular end walls (38) including apertures (42) in fluid communication with a compressed air enclosure (44) secured to the center plate (18). The free end of a continuous strip of coupon items is inserted into the infeed end where it is under the control of the air flow created by the air jets (36) within the tunnel. A coupon item is then cut from the continuous strip and travels under the control of the air flow within the tunnel and through the outfeed end thereof. In a preferred form, the end cover plate (22) is arcuately shaped outward and downward to direct the coupon item into a hopper (32) which later receives the ready-to-eat food product. In another preferred form, the coupon item is inserted between a previously filled and sealed bag and a carton receiving such bag.

19 Claims, 3 Drawing Sheets

APPARATUS AND METHODS FOR INSERTING FLAT PREMIUM ITEMS

BACKGROUND

The present invention generally relates to apparatus and methods for dispensing premium items, specifically relates to apparatus and methods for inserting flat premium items into packaging, and in the most preferred form relates to apparatus and methods for inserting coupon items into packaging.

Due to the fierce competition in the marketing of breakfast cereals, it is the practice of many cereal manufacturers to include a premium with the cereal to promote the sale of the cereal beyond the marketability of the cereal itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different boxes, cartons, or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

One type of promotional devices which meet these requirements and which have had successful market acceptance are flat premium items like coupons or the like which are placed with the product in the boxes of the product.

It can then be appreciated that customer dissatisfaction and complaints can arise if the printing located on the exterior of the box indicates that a promotional device is present when in fact for that particular box, the promotional device was omitted for whatever reason. Likewise, the promotional device can be positioned to be attached to the inner liner or bag and/or the box such as at the seal thereof, with the promotional device potentially not being usable or not detected by the customer. Further, if the promotional device is located at the seal, sealing of the packaging may not be complete resulting in the customer rejecting the product because of tampering concerns. Coupons are especially prone to misplacement due to their light weight and since they are easily blown about due to air currents arising from moving machinery or the like. In fact, such causes of customer dissatisfaction may actually reduce the marketability of the product if occurring frequently. It can then be appreciated that promotional devices can be placed in the boxes manually. Although greatly reducing the chance of omission or misplacement of the promotional devices, such manual placement is relatively expensive in both the labor required but also in the disruption of the normal handling of the product. Automatic placement by mechanical means is less costly in both labor and disruption of normal handling, but typically increases the possibility of omission or misplacement of the promotional device in the packaging.

It is thus an object of the present invention to provide novel apparatus and methods for placing promotional devices in packaging.

Yet another object of the present invention is to provide such novel promotional device placement apparatus and methods for inserting flat premium items such as coupons in packaging.

It is still further an object of the present invention to provide such a novel flat premium insertion apparatus and methods for placing the premium within the inner liner or bag of the packaging.

It is still further an object of the present invention to provide such a novel flat premium insertion apparatus and methods for placing the premium between the inner liner or bag and the box or carton of the packaging.

It is still further an object of the present invention to provide such a novel flat premium insertion apparatus and methods providing positive control during the placement of the premium.

It is still further an object of the present invention to provide such a novel flat premium insertion apparatus and methods including sensors to insure the placement of the premium.

SUMMARY

Surprisingly, the above objects and other aims can be satisfied in the field of the placement of promotional devices in packaging by providing, in a first aspect of the preferred form of the present invention, a flat premium item inserted into the infeed end of a generally closed tunnel having an air flow towards and through an outfeed end, with the premium item moving through the tunnel and the outfeed end with the air flow.

In a further aspect of the present invention, the premium item is inserted into the infeed end of a generally closed tunnel having an air flow therein towards and through the outfeed end, with the premium item being cut from a continuous strip after its insertion into the infeed end and when it is under the control of the air flow.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
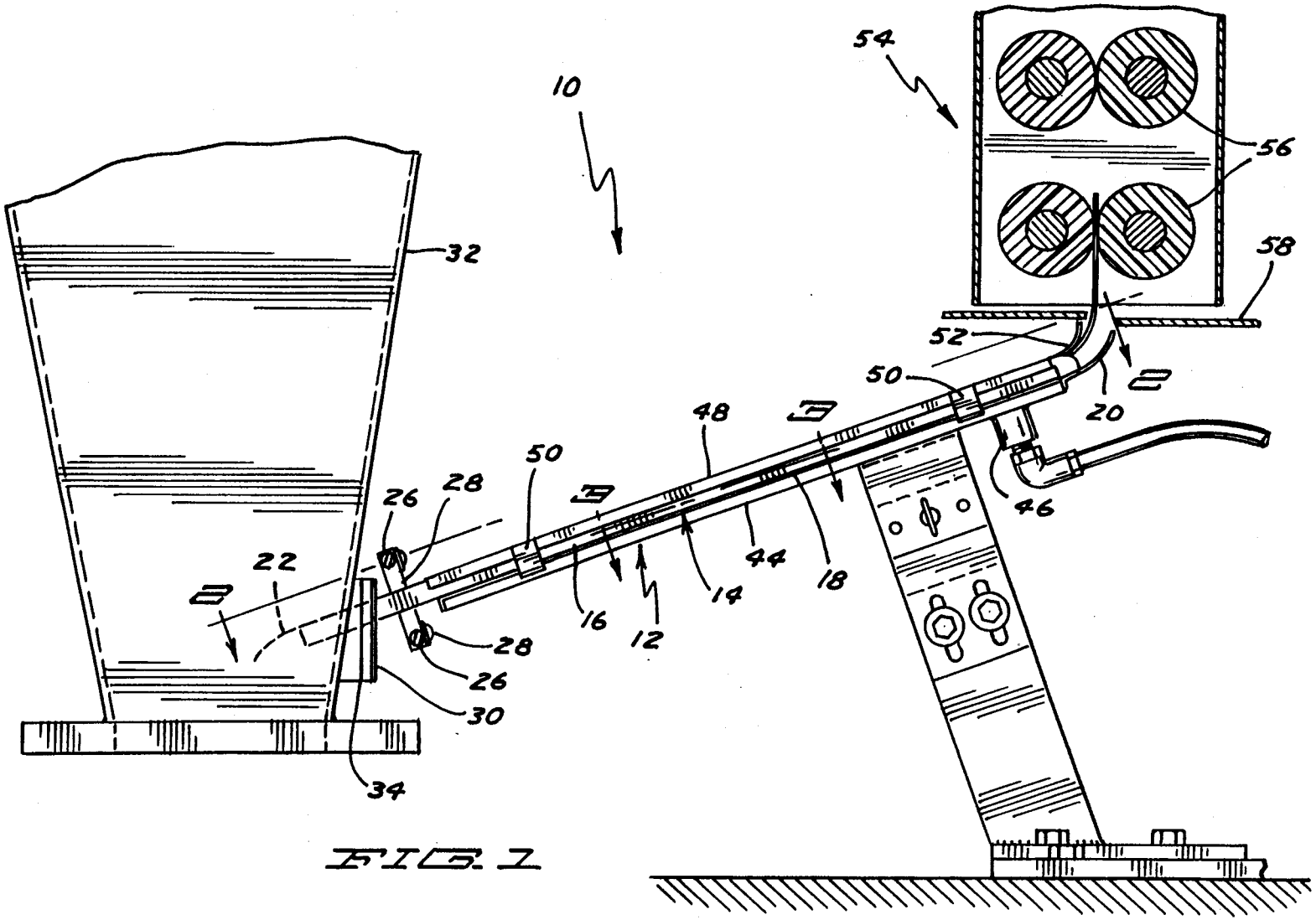
FIG. 1 shows a side view of the coupon dispensing apparatus utilizing the methods of the preferred forms according to the teachings of the present invention.
Figure 2:
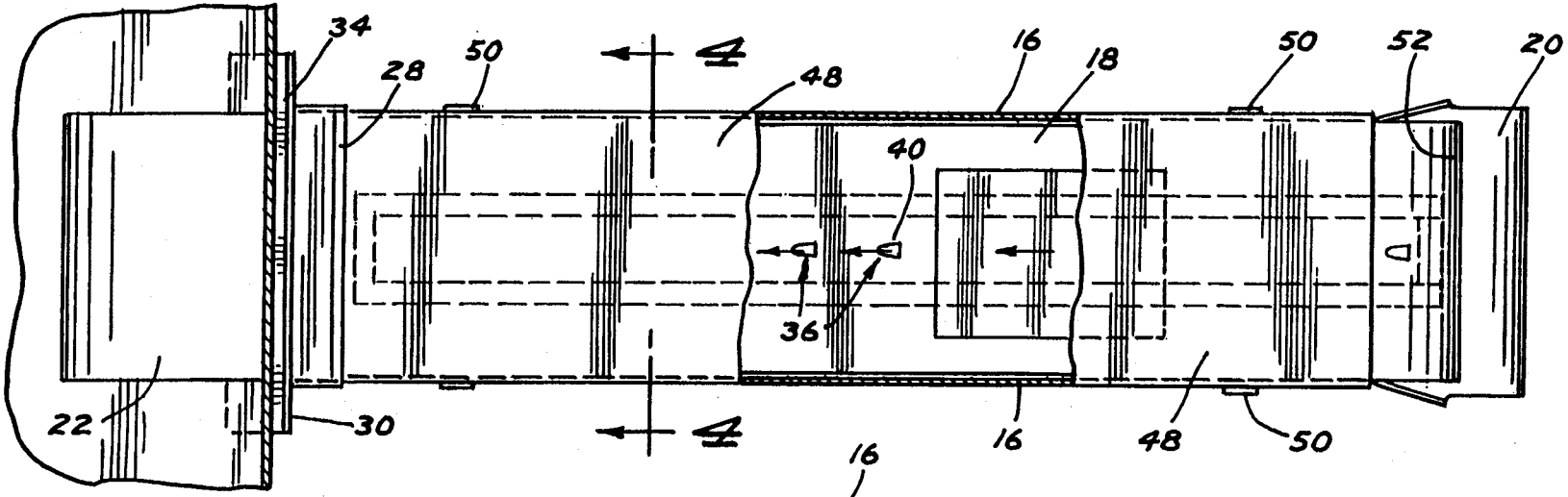
FIG. 2 shows a cross-sectional view of the coupon dispensing apparatus of FIG. 1 according to section line 2—2 of FIG. 1.
Figure 3:
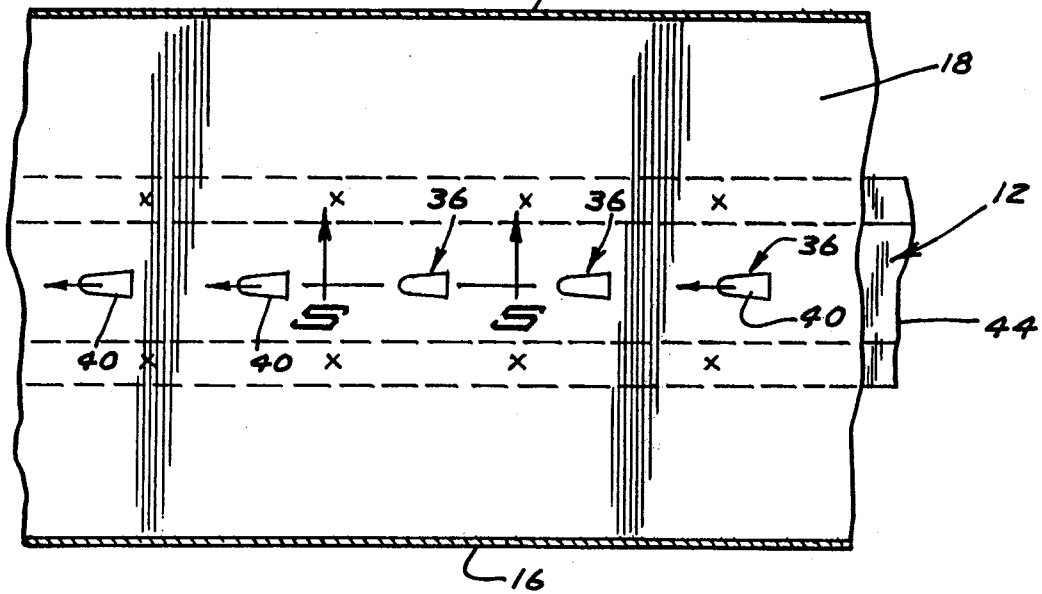
FIG. 3 shows an enlarged sectional view of the coupon dispensing apparatus of FIG. 1 according to section line 3—3 of FIG. 1.
Figure 4:
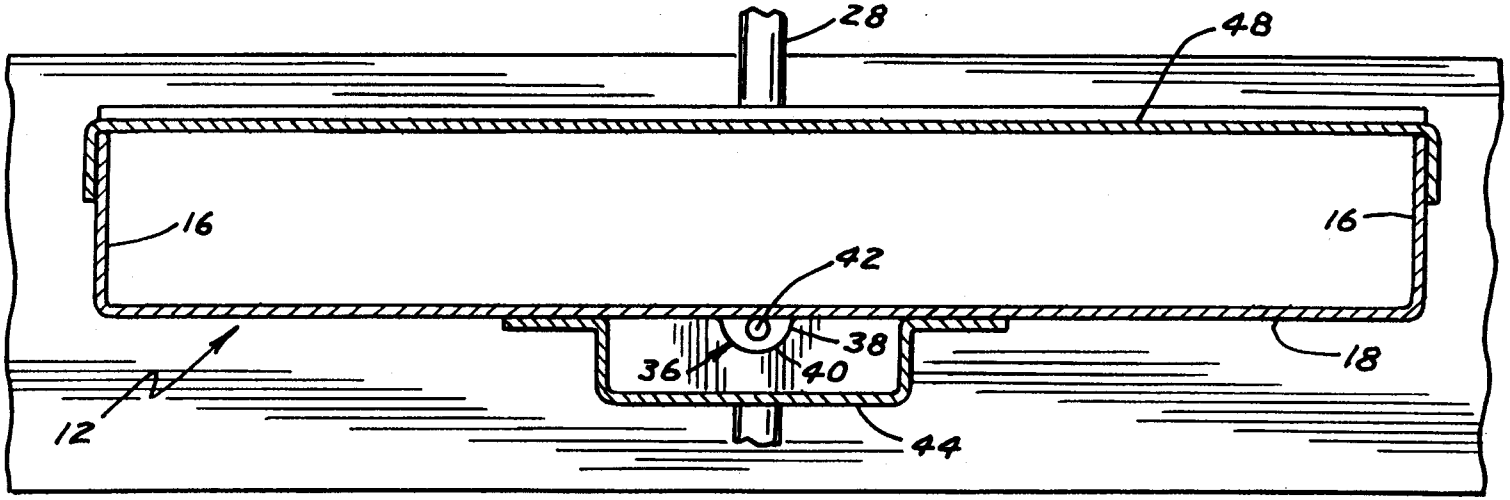
FIG. 4 shows a cross-sectional view of the coupon dispensing apparatus of FIG. 1 according to section line 4—4 of FIG. 2.
Figure 5:
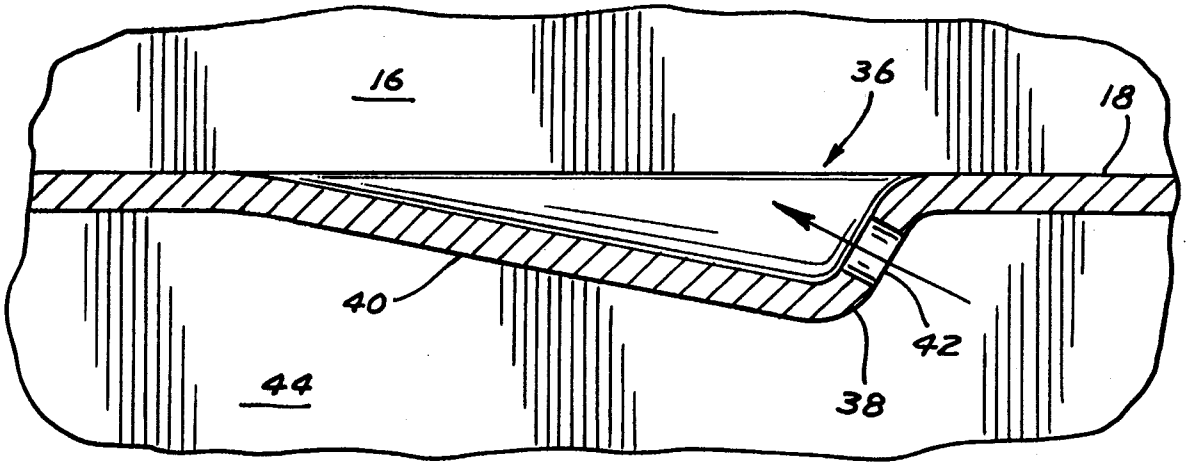
FIG. 5 shows an enlarged cross-sectional view of the coupon dispensing apparatus of FIG. 1 according to section line 5—5 of FIG. 3.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "upper", "lower", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Apparatus for inserting coupons or like flat premium items into a package according to the preferred teachings of the present invention is shown in the drawings and generally designated 10. In the most preferred form, apparatus 10 generally includes an air chute 12 of an elongated length. Generally air chute 12 includes an elongated underchute or channel 14 having generally U-shaped cross sections. Specifically, channel 14 includes first and second, flat, side plates 16 upstanding generally perpendicularly on opposite sides of a flat center plate 18. The infeed end of channel 14 includes an arcuately shaped plate 20 extending upwardly and outward from the infeed end of center plate 18. Plates 16 and 18 can flare outwardly adjacent the infeed end of chute 12 to act as a funnel for the introduction of coupons in chute 12. In the most preferred form, the width of center plate 18 and the spacing between plates 16 is generally equal to but slightly larger than the width of the coupon item to be dispensed for slideable receipt between plates 16. The height of side plates 16 is typically substantially larger than that of a coupon item such as in the order of $\frac{1}{4}$ inch (0.64 cm).

Air chute 12 further includes an outfeed end cover plate 22 attached to and extending between the upper edges of side plates 16 and extending from a point spaced inwardly from the outfeed end of channel 14 to beyond the outfeed end of channel 14, with the portion of end cover plate 22 extending beyond the outfeed end of channel 14 being arcuately shaped downwardly and outwardly from the outfeed end of channel 14. Sensor apertures are formed in end cover plate 22 and center plate 18 in an aligned manner. Suitable sensors 26 are mounted on opposite sides of air chute 12 by brackets 28 and aligned with the sensor apertures. A suitable mounting bracket 30 is positioned on air chute 12 outwardly of the sensor apertures and sensors 26 for mounting to a product fill hopper 32 in a first, preferred form, with the portions of air chute 12 located outwardly of bracket 30 extending through a slot formed in hopper 32 and into hopper 32. A suitable gasket 34 can be positioned between air chute 12 and hopper 32 to prevent the escape of dust or the like through the slot in hopper 32 and around air chute 12.

Air chute 12 further includes a series of equally spaced air jets 36 in plate 18 extending in a direction towards the outfeed end of air chute 12 and in the most preferred form intermediate and generally parallel to plates 16. Specifically, jets 36 are stamped dimples or depressions in plate 18 of a wedge shape and generally include a generally semicircular end wall 38 and a side wall 40 extending generally perpendicular from the periphery of end wall 38. End wall 38 extends generally at a major acute angle generally equal to but less than 90° and in the order of 80° in the most preferred form. It can then be appreciated that side wall 40 has the shape of a portion of a cylinder having a circular cross section of a radius equal to that of end wall 38 and due to the incline of end wall 38 terminates in center plate 18. An aperture 42 extends through end wall 38 having an axis at a minor acute angle to the axis of side wall 40 and the diametric center of end wall 38 in the order of 15°. A plenum, manifold, or enclosure 44 is attached to center plate 18 and encloses all air jets 36, with enclosure 44 and center plate 18 having generally rectangular cross sections in the most preferred form. A suitable source of compressed air is in fluid communication through an inlet 46 to the interior of enclosure 44 and to apertures 42 for introduction into air jets 36, with enclosure 44 containing air at 10–15 psi (700–1050 g/sq. cm).

Apparatus 10 further includes a cover 48 for closing the remaining portions of the free edges of side plates 16 from end plate 22 to the infeed ends of side plates 16. In the most preferred form, cover 48 is removably secured to channel 14 by ears 50 which snap over and abut with center plate 18 to allow access to the interior of channel 14. Cover 48 further includes an arcuate portion 52 extending upwardly and outward from the infeed end of chute 12 and having a radius less than the radius of plate 20, with plate 20 and portion 52 providing a funnel action to chute 12 for the coupon items.

Apparatus 10 further includes a coupon dispenser 54 such as a JENKO ® depositing device having a suitable mechanism 56 for vertically feeding a continuous strip of coupon items towards a cutting mechanism 58 which cuts a single length of coupon item from the continuous strip. In the most preferred form, cutting mechanism 58 is positioned at a spacing from the infeed end of air chute 12 less than the length of the coupon item such that the free end of the continuous strip is positioned intermediate plate 20 and portion 52 and preferably within the infeed end of chute 12 before the single length of coupon item is cut from the multiple length continuous strip by cutting mechanism 58. Center plate 18 is inclined downwardly at an acute angle from the infeed end to the outfeed end, with side plates 16 being generally vertical.

It can then be appreciated that channel 14, plate 22 and cover 48 of chute 12 define a generally closed envelope or tunnel having an open infeed end and an open outfeed end and which is inclined downwardly at an acute angle from the infeed end to the outfeed end. Due to their wedge shape, air entering this tunnel through air jets 36 will tend to flow with the path of least resistance which is towards the outfeed end of the tunnel.

Now that the basic construction of apparatus 10 according to the preferred teachings of the present invention has been explained, examples of preferred methods of operation of apparatus 10 can be set forth. Specifically, a bag can be positioned vertically below hopper 32 by any suitable means such as hanging down from a bag forming mandrel. A coupon is then dropped into the open bag. In the preferred form, the free end of the continuous strip of coupon items is fed by mechanism 56 between plate 20 and portion 52 and into the tunnel defined by chute 12 and cover 48 and beyond the initial air jets 36 of the series of air jets 36 formed in center plate 18. It can then be appreciated that the free end of the continuous strip will tend to be pulled under vacuum-type forces by the air flow or stream inside of the tunnel towards the outfeed end thereof and thus is captured and under the control of the air flow in the tunnel. At that time, the coupon item is cut from the continuous strip by cutting mechanism 58, with the severed coupon item moving with the air flow and under gravitational forces towards and out of the outfeed end of the tunnel at a relatively high velocity. It should be noted that if the coupon item was severed from the continuous strip prior to its introduction into the tunnel and control by the air flow therein, the severed coupon item may have a tendency to flounder and blow around and otherwise encounter problems in the introduction into the tunnel. The arcuate-shaped end portion of plate 22 helps insure that the coupon item leaving the tunnel defined by chute 12 will travel downward into hopper 32 and specifically not upward therein. After the coupon has been inserted into hopper 32 as sensed by sensors 26, the ready-to-eat food product or the like can be introduced into hopper 32 for gravity feed into the bag. It can then be appreciated that the food product will carry the coupon item down into the bag if not already there. Another advantage of inserting the coupon item into hopper 32 before the introduction of the food product into hopper 32 is that reduced dust/fine generation and propagation occurs. It can be appreciated that air to inlet 46 can be terminated when device 10 is not introducing the coupon item. After filling, the bag can be sealed and inserted into an open ended box or carton which in turn is sealed, with the package then being typically ready for commercialization.

Alternately, after a sealed bag filled with the food product has been inserted into a box or carton, a coupon item can be inserted into the box or carton intermediate the side of the box or carton and the filled bag by device 10 according to the preferred teachings of the present invention. It can be appreciated that insertion of the coupon item after the filled, sealed bag is at least substantially positioned in the box or carton is advantageous as positioning of the filled, sealed bag into the box or carton may force out a previously inserted coupon item out of the box or carton. After insertion of the coupon item, the box or carton can be sealed into its final, commercial form.

It can then be appreciated that positive control of the coupon item is made in apparatus 10 according to the preferred teachings of the present invention. Specifically, the coupon item as part of the continuous strip can be positioned in air chute 12 by mechanism 56 and under the control of the air flow produced inside of the tunnel prior to cutting by mechanism 58. It can be appreciated that plate 20 and portion 52 define an air vortex therebetween, with the coupon item being under suction to enter the infeed end of the tunnel due to the directional air flow therein. Due to the width between plates 16 being substantially equal to the width of the coupon item, the coupon item will tend not to cant or otherwise bind in the tunnel of air chute 12 after it is cut from the continuous strip and while it is traveling down the tunnel towards the outfeed end. Furthermore, the air stream produced inside of the tunnel by air jets 36 force or drive the coupon item in the tunnel towards the outfeed end and thus controls the coupon item preventing the coupon item from attempting to backtrack in the tunnel towards the infeed end or otherwise flounder in the tunnel. Further, the momentum of the coupon item resulting from being driven by the air flow inside of the tunnel insures that the coupon item is positioned at the desired final location in the packaging after it leaves the outfeed end of the tunnel and the control provided therein by the air flow.

It can also be appreciated that the creation of the air flow by jets 36 in the form of depressions according to the preferred teachings of the present invention is particularly advantageous. Specifically, the use of a series of depressions having apertures 42 located in a common enclosure 44 allows for the simultaneous introduction of air into the tunnel with a very simple construction including relatively few parts. Additionally, the wedge shape of the depressions having a size decreasing towards the outfeed end of the tunnel results in the air being sent in the direction in the tunnel that the coupon item is desired to be aimed to and having a generally laminar flow towards the outfeed while minimizing turbulent flow directions toward the infeed end. The particular shape of the depressions including end wall 38 and side wall 40 is also believed to enhance the control of the coupon item by the air flow as it travels through the tunnel of air chute 12.

Furthermore, sensors 26 such as of the fiberoptic type which senses when a beam of light is interrupted by the passage of a coupon item between the sensor apertures of center plate 18 and of plate 22 allow electronic control of the handling of the product to insure that every final commercial form of the product includes a coupon item.

It should be noted that apparatus 10 according to the teachings of the present invention is relatively maintenance free with air being the only moving part. Specifically, belts, pulleys, chains, and the like utilized in the prior placement of coupon items in boxes and cartons are not required, and similarly timing problems involved between the various moving parts of prior coupon placement devices are avoided. Additionally, the coupon item is not shaped or otherwise damaged such as wearing or rubbing off ink or patterns by apparatus 10 according to the preferred teachings of the present invention. Additionally, the coupon items in a continuous strip which are typically supplied in rolls generally require less machine supervision than when the coupon items are supplied separated from each other and fed from a magazine.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for inserting a flat premium item having a length and a width comprising, in combination: a generally closed tunnel for receipt of the flat premium item and having an infeed end, an outfeed end, and a plate extending from the infeed end to the outfeed end; and means for creating air flow in the tunnel towards and through the outfeed end comprising a series of air jets formed in the plate and extending in a direction towards the outfeed end of the tunnel, with each of the air jets comprising a wedge-shaped depression formed in the plate and having a size decreasing towards the outfeed end of the tunnel, with each of the depressions comprising, in combination: an end wall extending from the plate and terminating in a periphery, a side wall extending from the periphery of the end wall and from the plate, and an aperture formed in the end wall for passage of air for introducing air into the wedge-shaped depression, with the flat premium item being inserted into the infeed end for movement through the tunnel with the air flow and through the outfeed end; wherein the axis of the aperture is offset from the axis of the semi-circular shape of the end wall by a minor acute angle.

2. The device of claim 1 wherein the flat premium item is interconnected to a continuous strip having a free end before insertion into the infeed end of the tunnel, with the continuous strip having a length which is a multiple of the length of the flat premium item; and wherein the device further comprises, in combination: means for inserting the free end of the continuous strip into the infeed end of the tunnel, and means for cutting the flat premium item from the continuous strip, with the cutting means being positioned at a spacing from the infeed end less than the length of the flat premium item so that the free end of the continuous strip is under the control of the air flow inside the tunnel for exclusively driving the flat premium item in the tunnel from the infeed end towards and through the outfeed end.

3. The device of claim 1 wherein the end wall is generally semi-circular in shape, with the sidewall extending generally perpendicular to the end wall.

4. The device of claim 1 wherein the plate has a width generally equal to but slightly larger than the width of the flat premium item, with the plate being flat across the entire width aside from the series of air jets.

5. The device of claim 4 wherein the tunnel has rectangular-shaped cross sections, with the tunnel including first and second, spaced, parallel side plates extending generally perpendicularly from the plate and a removable cover including a central portion and first and second parallel legs extending generally perpendicular from the central portion, with the central portion being of a solid construction and extending between the side plates and parallel to the plate, with the first and second legs slideably received on the outside of the first and second side plates respectively.

6. The device of claim 5 wherein the cover includes an arcuately shaped portion extending downwardly and outwardly beyond the outfeed end of the tunnel.

7. The device of claim 5 wherein the plate includes an arcuately shaped portion extending upwardly and outwardly beyond the infeed end of the tunnel.

8. The device of claim 7 wherein the cover includes a closed arcuately shaped portion extending upwardly and outwardly beyond the infeed end of the tunnel, with the arcuately shaped portion of the cover being closed and having a smaller radius than of the arcuately shaped portion of the plate, with the arcuately shaped portions of the plate and the cover defining an air vortex therebetween with the flat premium item being under suction to enter the infeed end of the tunnel due to the air flow therein.

9. The device of claim 5 wherein the introducing means comprises an enclosure secured to the plate, with the enclosure and the plate defining an interior for receipt of compressed air, with the depressions formed in the plate and extending from the plate into the interior defined by the enclosure and the plate.

10. The device of claim 1 wherein the introducing means comprises an enclosure secured to the plate, with the enclosure and the plate defining an interior for receipt of compressed air, with the depressions formed in the plate and extending from the plate into the interior defined by the enclosure and the plate.

11. The device of claim 1 wherein the tunnel is inclined downwardly from the outfeed end to the infeed end at an acute angle.

12. Method for inserting a flat premium item having a length and a width comprising the steps of providing a generally closed tunnel having an infeed end and an outfeed end; flowing air in a direction inside the tunnel towards and through the outfeed end for exclusively driving the flat premium item in the direction in the tunnel from the infeed end towards and through the outfeed end; providing a continuous strip of flat premium items having a length which is a multiple of the length of the flat premium item and having a free end; inserting the free end of the continuous strip into the infeed end of the tunnel and within the control of the air flow flowing in the direction inside the tunnel; and cutting the flat premium item from the continuous strip while the free end of the continuous strip is under the control of the air flow flowing in the direction inside the tunnel for movement of the flat premium item with the air flow through the tunnel and the outfeed end.

13. The method of claim 12 wherein the step of providing the tunnel comprises the step of providing the tunnel inclined downwardly at an acute angle from the outfeed end to the infeed end.

14. The method of claim 13 wherein the step of providing the tunnel comprises the step of providing the tunnel having rectangular-shaped cross sections, with the tunnel including a plate, first and second, spaced, parallel side plates extending generally perpendicularly from the plate and a cover extending between the side plates and parallel to the plate; and wherein the step of flowing air comprises the steps of providing a series of wedge-shaped depressions in the plate and extending in a direction towards the outfeed end of the tunnel, with the depressions each having a size decreasing towards the outfeed end of the tunnel, and communicating air to the depressions for movement in the depressions towards the outfeed end of the tunnel.

15. The method of claim 14 wherein the step of providing the tunnel comprises the step of providing the plate including a closed arcuately shaped portion extending upwardly and outwardly beyond the infeed end of the tunnel and the cover including a closed arcuately shaped portion extending upwardly and outwardly beyond the infeed end of the tunnel, with the arcuately shaped portion of the cover having a smaller radius than of the arcuately shaped portion of the plate, with the arcuately shaped portions of the plate and the cover defining an air vortex therebetween with the flat premium item being under suction to enter the infeed end of the tunnel due to the air flow therein.

16. The method of claim 15 wherein the step of providing the tunnel comprises the step of providing the cover including an arcuately shaped portion extending downwardly and outwardly beyond the outfeed end of the tunnel.

17. Device for inserting a flat premium item having a length and a width comprising, in combination: a generally closed tunnel for receipt of the flat premium item and having rectangular-shaped cross sections and having an infeed end and an outfeed end, with the tunnel including a plate extending from the infeed end to the outfeed end, first and second, spaced, parallel side plates extending generally perpendicularly from the plate and a cover extending between the side plates and parallel to the plate; and means for creating air flow in the tunnel towards and through the outfeed end, with the flat premium item being inserted into the infeed end for movement through the tunnel with the air flow and through the outfeed end, with the plate including a closed arcuately shaped portion extending upwardly and outwardly beyond the infeed end of the tunnel, with the cover including a closed arcuately shaped portion extending upwardly and outwardly beyond the infeed end of the tunnel, with the arcuately shaped portion of the cover having a smaller radius than of the arcuately shaped portion of the plate, with the arcuately shaped portions of the plate and the cover defining an air vortex therebetween with the flat premium item being under suction to enter the infeed end of the tunnel due to the air flow therein.

18. The device of claim 17 wherein the cover includes an arcuately shaped portion extending downwardly and outwardly beyond the outfeed end of the tunnel, with the air flow creating means comprising a series of air jets formed in the plate and extending in a direction towards the outfeed end of the tunnel.

19. The device of claim 17 wherein the flat premium item is interconnected to a continuous strip having a free end before insertion into the infeed end of the tunnel, with the continuous strip having a length which is a multiple of the length of the flat premium item; and wherein the device further comprises, in combination: means for inserting the free end of the continuous strip into the infeed end of the tunnel, and means for cutting the flat premium item from the continuous strip, with the cutting means being positioned at a spacing from the infeed end less than the length of the flat premium item so that the free end of the continuous strip is under the control of the air flow inside the tunnel for exclusively driving the flat premium item in the tunnel from the infeed end towards and through the outfeed end.

* * * * *